US006033820A

United States Patent [19]

Hayashi et al.

[11] Patent Number: 6,033,820

[45] Date of Patent: Mar. 7, 2000

[54] TONER FOR DEVELOPING AN ELECTROSTATIC IMAGE

[75] Inventors: Kenji Hayashi; Naohiro Hirose; Yoshiki Nishimori; Tomoe Kitani; Mikio Kohyama, all of Hino, Japan

[73] Assignee: Konica Corporation

[21] Appl. No.: 09/276,934

[22] Filed: Mar. 26, 1999

[30] Foreign Application Priority Data

Mar. 31, 1998 [JP] Japan ..... 086037/1998

[51] Int. Cl.[7] ..... G03G 9/087

[52] U.S. Cl. ..... 430/109; 430/111

[58] Field of Search ..... 430/109, 111

[56] References Cited

U.S. PATENT DOCUMENTS 4,379,825 4/1983 Mitsuhashi ..... 430/109

5,476,744 12/1995 Anno ..... 430/111

5,618,647 4/1997 Kukimoto et al. ..... 430/106.6

5,663,026 9/1997 Kasuya et al. ..... 430/111

5,774,771 6/1998 Kukimoto et al. ..... 430/109

*Primary Examiner*—Roland Martin

*Attorney, Agent, or Firm*—Jordan B. Bierman; Bierman, Muserlian and Lucas

[57] ABSTRACT

A toner for developing an electrostatic image is disclosed. The toner is composed of association of a plurality of fine polymer particles, and the total volume of pores having a diameter of not more than 0.1 $\mu$m on the toner surfaces is not more than 30 percent of the total toner volume. An image forming method employing the same is also disclosed. A toner which does not result in an unstable charge amount over an extended period of use can be obtained.

20 Claims, 2 Drawing Sheets

TONER FOR DEVELOPING AN ELECTROSTATIC IMAGE

FIELD OF THE INVENTION

The present invention relates to toner for developing an electrostatic image, which is employed in copiers, printers, and the like, and to an image forming method using the same.

Heretofore, toners which have generally been employed, have been produced in such a manner that polymers, prepared by employing various polymerization methods, are appropriately dry-mixed with colorants such as carbon black, etc. and charge control agents and/or magnetic materials; the resulting mixture is then melt-kneaded employing an extruder, etc.; and is then pulverized and classified.

However, the toner, which is prepared employing the above-mentioned melt-knead-pulverized method, is subjected to limitation in control of the particle diameter. As a result, it has been difficult to efficiently produce toners of small particle diameter. Moreover, the charge distribution tends to be broad due to the lack of uniformity of components composing the toner. Due to that, when the toner is employed as a developer material, disadvantages such as low resolution and high likeliness of formation of background staining and scattering, etc. result.

Furthermore, proposed is a direct production method employing suspension polymerization. However, this method results in disadvantages in which it is difficult to produce particles of small diameter, and moreover, the particle size distribution is markedly broad. Furthermore, the toner which is produced employing the polymerization method results in true spheres. This toner of true spheres results in disadvantages in which when remaining on an electrophotographic photoreceptor, it is difficult to remove the residual toner.

Namely, methods disclosed in Japanese Patent Publication Open to Public Inspection Nos. 60-220358 and 4-284461 are those which enable the production of non-spherical particles. However, in these methods, it is difficult to control the particle diameter as well as particle size distribution. As a result, classification is required. Furthermore, in a method disclosed in Japanese Patent Publication Open to Public Inspection No. 4-284461, it is difficult to adjust the zeta potential of pigments and polymer particles. Furthermore, even though particle are prepared employing this method, desired properties are not obtained if the ratio of large particles to small particles is not exactly specified. However, no specification is described, and further, prepared particles result in disadvantage in the lack of mechanical strength due to the fact that the formed particles cannot have a solid structure.

In order to overcome these disadvantages, a production method is proposed in Japanese Patent Publication Open to Public Inspection No. 6-329947.

However, it has been clarified that most of the toners prepared employing this method result in an unstable charge amount over an extended period of use. Further, it has been found that fine polymer particle association type toner prepared employing other methods result in the similar tendency.

SUMMARY OF THE INVENTION

An object of the present invention is to provide toner which does not result in an unstable charge amount over an extended period of use, and an image forming method employing the same. Another object of the present invention is to provide toner which results in excellent cleaning properties and images with high resolution, and minimum background staining and scattering, and an image forming method employing the same.

In toner for developing an electrostatic image of the present invention, which is composed of association of a plurality of fine polymer particles, toner for developing an electrostatic image in which the total volume of pores having a pore diameter not more than 0.1 $\mu$m on the surfaces of the toner particles is not more than 30 percent of the volume of all pores on the surfaces of the particles.

The above-mentioned toner for developing an electrostatic image, in which fine polymer particles comprise a monomer unit having an ionic dissociation group.

The above-described toner for developing an electrostatic image, in which fine polymer particles comprise a monomer unit having an ionic dissociation group, and a part or all of the ionic dissociation groups are in a dissociated state.

An image forming method in which an electrostatic image formed on a photoreceptor is developed employing the above-mentioned toner to form a toner image.

An image forming method in which a toner image formed on a photoreceptor employing the above-mentioned toner is transferred onto a transfer material.

An image forming method in which after a toner image is formed on a photoreceptor employing the above-mentioned toner, any toner which remains on the photoreceptor is removed employing an cleaning means.

DETAILED DESCRIPTION OF THE INVENTION

Figure 1:
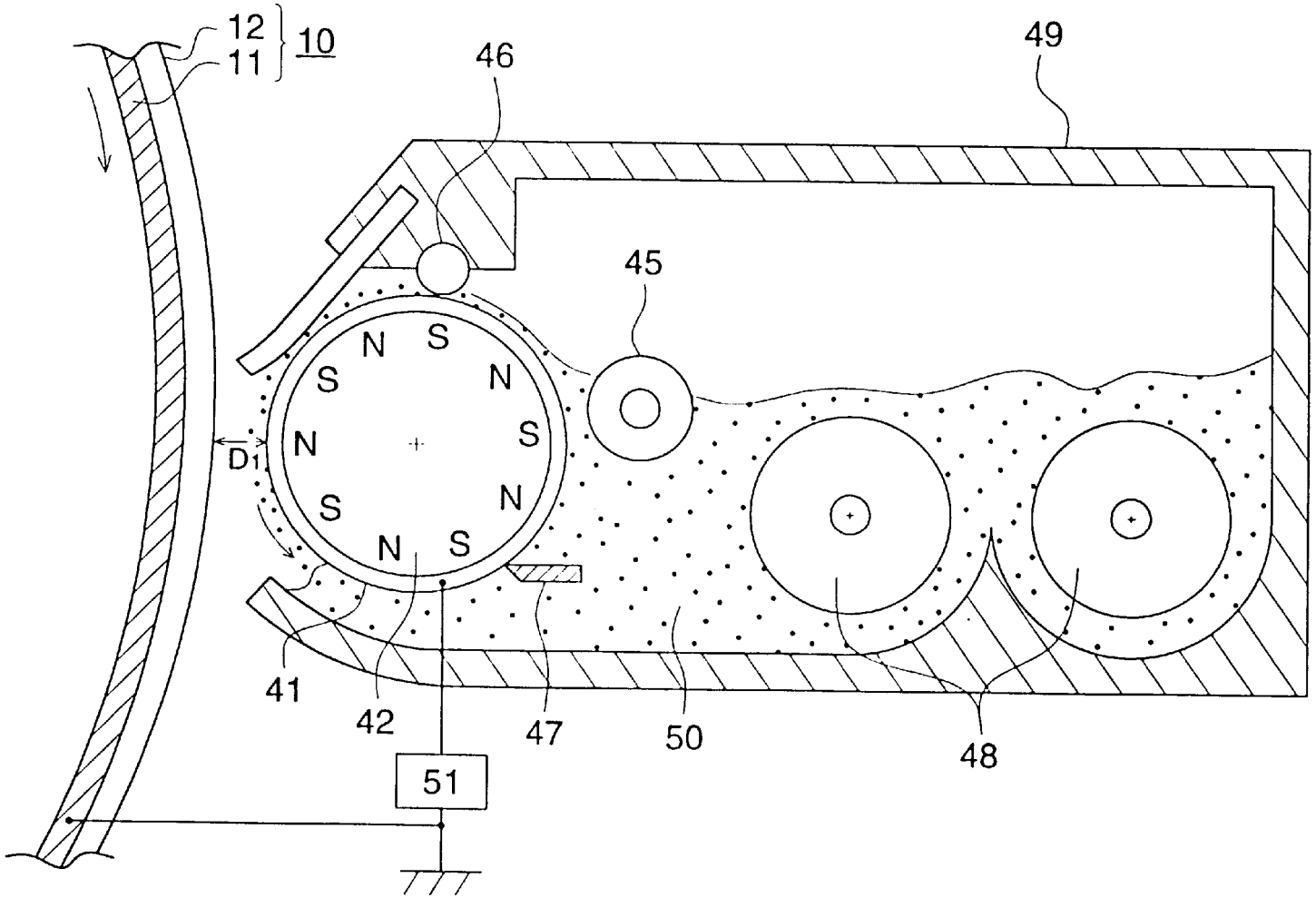
FIG. 1 is a sectional view showing one example of the development apparatus according to the present invention.

The toner of the present invention is prepared by controlling the existing amount of pores having a diameter of not more than 0.1 $\mu$m on the surface of toner particles compared to all the pores on the surface of toner particles. Resin particles employed in the toner are prepared employing an association method, and fine polymer particles have an associated structure. Therefore, it is required to have close adhesion among particles. It has been found that the adhesion properties are improved by decreasing pores having a diameter less than the specified value. The fact that there are many pores with the specified pore diameter, that is not more than 0.1 $\mu$m, shows that there are minute cracks from the surface of the particle to the interior. When stress is applied to toner particles due to the presence of cracks, pulverization results. As a result, it is estimated that pulverized pieces adhere to carrier, which work as a charge donating member to cause problems of increasing chargeability. Due to that, it is estimated that by decreasing the amount of pores with a diameter of no more than 0.1 $\mu$m, the tendency of pulverization of the toner itself is reduced.

Fine polymer particles for forming resin particles, which are employed as toner, may be those prepared by employing a so-called particle forming polymerization or those prepared by pulverizing polymers. These fine polymer particles are associated under a state of dispersion in water to form toner particles. The pore volume on toner surfaces may be controlled employing a solvent which is used to wash out foreign matter after preparing toner particles in an aqueous phase. In this case, it is preferred that washing is carried out employing a solvent which does not dissolve the resin composing toner particles. As such solvents which do not dissolve the resin, listed can be water, methanol, ethanol, isopropyl alcohol, etc. It is especially preferred that washing is carried out employing solvents which do not cause the resin to swell. When the solvent which does not dissolve the resin composing such toner and causes the resin to swell is employed, there is a possibility in which the solvent penetrates into the interior of the particle and the solvent, when dried, causes minute cracks.

Furthermore, as another factor to control the pore volume on toner surfaces, temperature and the speed of drying fine polymer particles may be listed. Namely, the drying temperature on the surface of the resin composing toner particles is elevated nearly to the glass transition temperature. As a result, it is possible to improve the adhesion properties among particles. Furthermore, regarding the drying speed, employing a slow drying method is more preferred than a rapid one. The reason for this is not however fully understood. When rapid drying is carried out, drying of particle boundaries is accelerated which cause a problem in the formation of minute cracks on the surface.

From the above-mentioned view point, regarding the drying temperature, preferred is the glass transition temperature 0 to 25° C. for resins composing a polymer. As drying, in order to establish no rapid drying conditions, drying under normal atmospheric pressure is more preferred than drying under evacuation.

Herein, the volume of pores on the toner surface is measured by using a pore distribution measurement apparatus in which mercury is introduced under pressure. As measurement conditions, employing high pressure, measurement is carried out at a pressure range of 0.50 to 30,000.00 psia. Employing a histogram showing the relationship between the pore diameter and the volume corresponding to the pore diameter, the total volume of pores having a diameter of not more than 0.1 $\mu$m is obtained. The obtained value is represented by (A) as the total volume of pores having a pore diameter of not more than 0.1 $\mu$m. On the other hand, (B) representing the total pore volume of toner, is obtained, and a ratio can be obtained employing the formula of $[(A)/(B)]\times 100$.

In order to ensure sufficient mechanical strength of toner and to minimize a decrease in charge amount with agitation of the carrier, with the pore volume of toner surfaces, it is required that the total volume of pores with a pore diameter of not more than 0.1 $\mu$m is not more than 30 percent of the total pore volume of toner surfaces, and is more preferably not more than 25 percent.

When there are many pores, it is estimated that, in practice, pores are likely to clog due to agitation with the carrier, and the surface state, that is, physical property values, is altered. Toner particles of the present invention are non-spherical particles composed of association of a plurality of fine polymer particles. For example, the non-spherical particles are obtained upon processing with a coagulant in an amount of not less than the critical coagulation concentration for a fine polymer particle dispersion and an infinite water-soluble organic solvent.

The production method of non-spherical particles formed through the association of a plurality of fine polymer particles includes:

a) a process in which the coagulant in an amount of more than the critical coagulation concentration is added to a fine polymer particle dispersion, b) a process in which an infinite water-soluble organic solvent is added to the fine polymer particle dispersion, and furthermore, may include a claim of:

c) a process in which the above-mentioned mixture is heated at temperature higher than the glass transition temperature of the fine polymer particles.

The present invention will be detailed below.

(Coagulants)

The coagulants employed in the present invention are preferably selected from metallic salts.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application. Generally, the critical coagulation concentration (coagulation value or coagulation point) of divalent metallic salts is less than that of monovalent metallic salts. Furthermore, the critical coagulation concentration of trivalent metallic salts is lowered.

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the $\zeta$ potential of the dispersion, and in addition the critical coagulation concentration may be obtained as the salt concentration which initiates a variation in the $\zeta$ potential.

The concentration of coagulant may be not less than the critical coagulation concentration. However, the amount of the added coagulant is preferably at least 1.2 times of the critical coagulation concentration, and more preferably 1.5 times.

(Infinite Water-soluble Organic Solvents)

The "infinite water-soluble organic solvent" is a solvent which can form uniformly a mixed solution with water at any mix-ratio, and those which do not dissolve fine polymer particles are preferred. Specific examples include alcohols such as methanol, ethanol, propanol, isopropanol, t-butanol, methoxyethanol, ethoxyethanol, butoxyethanol, etc., nitrites such as acetonitrile, etc., dioxane, etc.

An infinite water-soluble organic solvent is suitably selected from the range of 100 to 300 percent for the fine polymer particle dispersion to which a coagulant has been added.

(Fine Polymer Particles)

Generally, in order to obtain fine polymer particles, it is possible to use those prepared employing an emulsification polymerization method, a suspension polymerization method, a dispersion polymerization method, a precipitation polymerization method, and an interfacial polymerization method, also acceptable is to use finely pulverized powder of a synthetic resin, etc. However, fine polymer particles prepared by employing the emulsification polymerization method are preferred.

The diameter of these fine polymer particles may be arbitrary if it is less than the particle diameter of non-spherical particles which are finally employed to prepare the toner. Generally the diameter of such fine polymer particles employed is preferably between 0.01 and 10 $\mu$m, and is more preferably between 0.01 and 2 $\mu$m.

(Monomers)

In order to obtain the fine polymer particles of the present invention, hydrophobic monomers are employed. Moreover, it is preferred to incorporate monomers having an ionic dissociation group. Monomers having such an ionic dissociation group may be preferably incorporated at a ratio of 0.1 to 30 weight percent of the total monomers, and more preferably in the range of 0.5 to 20 weight percent. After the formation of toner particles, preferably at least one part of the ionic dissociation groups is in a dissociated state.

Specific examples of hydrophobic monomers of the present invention include, for example, styrene derivatives such as, for example, styrene, p-methylstyrene, o-methylstyrene, p-chlorostyrene, o-chlorostyrene, p-methoxystyrene, o-methoxystyrene, p-ethoxystyrene, p-butoxystyrene, 2,4-dimethylstyrene, 2,4-dichlorostyrene, p-chloromethylstyrene, o-chloromethylstyrene, p-hydroxystyrene, o-hydroxystyrene, etc. Furthermore, they include acrylic (or methacrylic) acid esters such as methyl acrylate or methacylate), ethyl acrylate (or methacrylate), n-butyl acrylate (or methacrylate), 2-ethylhexyl acrylate (or methacrylate), cyclohexyl acrylate or methacrylate), dodecyl acrylate (or methacrylate), etc. In addition, they include nitrile series monomers such as acrylonitrile, methacrylonitrile, etc.; vinyl ether series monomers such as vinyl methyl ether, vinyl ethyl ether, etc.; vinyl ester series monomers such as vinyl acetate, vinyl butyrate, etc.; olefin series monomers such as ethylene, propylene, isobutylene, etc.; and conjugate dienes such as butadiene, isoprene, chloroprene, dimethylbutadine, etc. If desired, these may be employed individually or in combination. Furthermore, these may be employed in combinations with monomers having an ionic dissociation group as described below.

A "monomer unit having an ionic dissociation group" is a monomer in which any of groups such as a carboxyl group, a sulfonic acid group, a phosphoric acid group, an amino group (including a primary, secondary, and tertiary amine, etc.), a quaternary ammonium group, etc. are incorporated into the structure of the monomer. Specific examples include, for example, as a monomer comprising a carboxyl group, acrylic acid, methacrylic acid, maleic acid, itaconic acid, cinnamic acid, fumaric acid, maleic acid monoalkyl ester, itaconic acid monoalkyl ester, etc. Listed as monomers having a sulfonic acid group, are styrene sulfonic acid, allylsulfosuccinic acid, 2-acrylamide-2-methylpropane sulfonic acid, 2-sulfoethyl methacrylate and salts thereof. Listed as monomers having a phosphoric acid group, are acid phosphoxyethyl methacrylate, acid phosphoxypropyl methacrylate, 3-chloro-2-acid phosphoxypropyl methacrylate, etc.

Furthermore, listed are an amino group-substituted acrylic (methacrylic) acid esters or acrylic (methacrylic) acid amide or acrylic (or methacrylic) acid amide which is subjected to mono- or di-substitution with an alkyl group having from 1 to 10 carbon atoms on an arbitrary nitrogen atom, or vinyl compounds substituted with a heterocyclic ring having a nitrogen atom as a ring member, and N-diallylalklylamines or quaternary ammonium salts thereof. Listed as specific examples of these acrylic (or methacrylic) acid esters, can be dialkylaminoalkyl acrylate (or methacrylate)(for example, dimethylaminoethyl acrylate, dimethylaminoethyl methacrylate, diethylaminoethyl acrylate, diethylaminoethyl methacrylate, etc.), and acid salts or quaternary ammonium salts thereof, 3-dimethylaminophenyl acrylate, 2-hydroxy-3-methacryloxypropyltrimethyl ammonium salt, etc.

Listed as specific examples of acrylic (or methacrylic) acid amides or acrylic (or methacrylic) acid amides which are subjected to mono- or di-substitution with an alkyl group having from 1 to 18 carbon atoms on an arbitrary nitrogen atom, can be, for example, acrylamide (or methacrylamide), N-butyl acrylamide or methacrylamide), N,N-diethyl acrylamide (or methacrylamide), piperadyl acrylamide (or methacrylamide), N-octadecyl methacrylamide, etc.

Listed as specific examples of vinyl compounds which are substituted with a heterocyclic ring having a nitrogen atom as a ring member, and N,N-diallylalkylamines or quaternary ammonium salts thereof, can be, for example, vinylpyridine, vinylpyrrolidone, vinylimidazole, and quaternary ammonium salts thereof, and in addition, N,N-diallylmethyl ammonium chloride, N,N-diallylethyl ammonium chloride, etc.

Furthermore, it is possible to employ monomers having an active halogen such as vinylbenzyl chloride, vinyl phenethyl chloride, etc. For example, after copolymerization is carried out employing any of these as they are, as a copolymerization component, it is possible to change the resulting product to a tertiary amine or a quaternary ammonium salt by employing an appropriate amine. Furthermore, as a dialkylamine or quaternary ammonium salt, copolymerization may be carried out. For example, into vinylbenzyl chloride, dialkyl amine may be introduced through reaction with a monomer or a polymer reaction.

These various monomers described above are selected in accordance with the purpose, for example, desired glass transition temperature, fusing temperature, etc.

(Radical Polymerization Initiator)

When fine polymer particles are synthesized, a radical polymerization initiator is selected depending on the polymerization method. Namely, in the case of a suspension polymerization method, an oil-soluble radical polymerization initiator is employed, while in the case of an emulsification polymerization method, a water-soluble radical polymerization initiator is employed. Furthermore, in the case of a dispersion polymerization, selection is carried out in accordance with the employed dispersion medium. However, when a non-aqueous solvent is employed, and a solvent consisting of a water-compatible organic solvent and water is employed, it is possible to use a water-soluble radical polymerization initiator.

Listed as examples of the water-soluble polymerization initiators, are persulfate salts such as, for example, potassium persulfate, ammonium persulfate, etc., water-soluble azo compounds such as, for example, azobisaminodipropane acetic acid salt, azobiscyanovaleric acid and salts thereof, etc., and water-soluble peroxides such as, for example, hydrogen peroxide, etc.

Listed as examples of the oil-soluble polymerization initiators, are oil-soluble peroxides such as, for example, benzoyl peroxide, lauroyl peroxide, etc. Listed as oil-soluble azo series polymerization initiators, are azobisisobutylonitrile, azobisvaleronitrile, etc. The added amount of these can be determined depending on the molecular weight, etc. of the desired fine polymer particles.

Furthermore, it is possible to list, if desired, molecular weight control agents, for example, chain re-positioning agents represented by thiol compounds, for example, dodecanethiol, octylthiol, etc.

The Tg of fine polymer particles is preferably −10 to 120° C., and is more preferably in the range of 0 to 90° C. Furthermore, the softening point is 80 to 220° C. The monomer composition of the above-mentioned fine polymer particles falls within these ranges, and polymer units having a dissociation group may be incorporated in an amount of 1 to 20 weight percent of the polymer, irrespective of type and composition of other copolymerization monomers.

The molecular weight of the fine polymer particles is not particularly limited. However, when used as a toner, the molecular weight is to be between 2,000 and 1,000,000 in terms of weight average molecular weight, and is preferably between 8,000 and 500,000. Furthermore, the molecular weight distribution is to be between 1.5 and 100 in terms of the ratio (hereinafter referred to as Mw/Mn) of the weight average molecular weight to the number average molecular weight, and is preferably between 1.8 and 50.

(Solid Components)

The fine polymer particles may form a toner, in combination with solid components, which are required to form the toner. As solid components are common materials such as pigments and dyes as colorants, and furthermore, fixability improving agents, charge control agents, etc. may be employed. These solid components may be associated with the fine polymer particles by dispersing these into an aqueous medium. Furthermore, methods may be listed, in which when the fine polymer particles are formed, solid components are dispersed into monomers forming the fine polymer particles, or after dissolving the solid components employing a polymerization method, they are introduced into the fine polymer particles themselves. These methods may be employed in any combination.

Listed as pigments, are inorganic pigments and organic pigments. Inorganic pigments include, for example, carbon series pigments such as carbon black, graft carbon, Firness black, Sumertomic carbon, etc.; metal oxide series pigments such as magnetite, ferrite, red iron oxide, titanium oxide, zinc white, silica, chromium oxide, cobalt blue, ultramarine, cerulean blue, mineral violet, trilead tetroxide, etc.; metal powder series pigments such as zinc powder, iron powder, copper powder, etc.; sulfide series pigments such as zinc sulfide, cadmium red, mercury sulfide, selenium red, cadmium yellow, etc.; chromic acid salt series pigments such as molybdenum red, barium yellow, strontium yellow, chrome yellow, etc.; ferrocyanate salt series pigments, etc.

Organic pigments include compounds described in Color Index, etc. Listed as cyan or green pigments, are, for example, C.I. Pigment Blue 15, C.I. Pigment Blue 15:2, C.I. Pigment Blue 15:3, C.I. Pigment Blue 16, C.I. Pigment Blue 60, and C.I. Pigment Green 7.

Listed as magenta or red pigments, are C.I. Pigment Red 2, C.I. Pigment Red 3, C.I. Pigment Red 5, C.I. Pigment Red 7, C.I. Pigment Red 15, C.I. Pigment Red 16, C.I. Pigment Red 48:1, C.I. Pigment Red 53:1. C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 178, C.I. Pigment Red 222, etc.

Listed as yellow or orange pigments, are C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, C.I. Pigment Yellow 180, etc.

Generally, employed as the cyan organic pigment, are copper-phthalocyanine known as C.I. Pigment Blue 15:3, and as the magenta organic pigment, dimethylquinacrydone known as C.I. Pigment Red 122, and as the yellow organic pigment, disazo yellow known as C.I. Pigment Yellow 17.

Furthermore, employed as the fixability improving agents, are, for example, low molecular weight polyethylene, low molecular weight polypropylene, polyethylene subjected to oxidation treatment, polypropylene subjected to oxidation treatment, polyethylene subjected to acid modified treatment, polypropylene subjected to acid modified treatment, polyolefin series wax (for example, Hitech manufactured by Toho Kagaku Kogyo Co.), etc.

Furthermore, employed may be positive electrostatic charge control agents such as Nigrosine series electron donating dyes, metal salts of naphthenic acid and higher fatty acid, alkoxylated amines, quaternary ammonium salts, alkylamides, metal complexes, pigments, fluorine-treated surface active agents, electron accepting organic complexes, and negative electrostatic charge control agents such as chlorinated paraffin, chlorinated polyesters, sulfonylamines of copper phthalocyanine, etc.

Generally, these are incorporated into each polymer in an amount of 1 to 25 percent by weight.

(Non-spherical Shape Forming Reaction)

Non-spherical particles (colored particles; as described below, these particles may be employed as toner either as they are or upon being added with external additives) are prepared by associating a plurality of fine polymer particles. As described above, in this case, a colorant in a dispersed form may be added at the time when a plurality of fine polymer particles are associated and allows to combine with the particles during the association.

The non-spherical particles may be prepared in such a manner that a coagulant is added under stirring to a fine polymer particle dispersion in an amount of at least the critical coagulation concentration; preferably, an infinite water-soluble organic solvent is added; and the resulting mixture is heated to a temperature higher than the Tg of the fine polymer particles.

The average particle diameter as well as particle distribution of these non-spherical particles are determined by coagulant concentration, addition concentration of an infinite water-soluble organic solvent, and further, by the degree of dissociation of the monomer unit having an ionic dissociation group of polymer particles. For example, when the addition concentration of an infinite water-soluble organic solvent, temperature, and the degree of dissociation of the monomer unit having an ionic dissociation group of polymer particles are kept constant, the particle diameter generally increases with an increase in the coagulant concentration, and it decreases with a decrease in the coagulant concentration. In the same manner, when the coagulant concentration and degree of dissociation of the monomer unit having an ionic dissociation group of polymer particles are kept constant, the particle diameter increases with an increase in the addition concentration of an infinite water-soluble organic solvent, while it decreases with a decease in the addition concentration. Furthermore, when the degree of dissociation of the monomer unit having an ionic dissociation group of polymer particles is varied, the particle diameter decreases with an increase in the degree of dissociation, and the particle diameter of formed particles increases with a decrease in the degree of dissociation.

Namely, the desired particle diameter may be obtained by appropriately changing the three factors above-mentioned. Furthermore, particles with a markedly narrow particle distribution may be obtained by utilizing the function of these three factors.

(Production Method)

Typically, toner is produced by adding under stirring a required amount of a metallic salt or an aqueous metallic salt solution into a fine polymer particle dispersion. In addition, processes are basically such that an infinite water-soluble organic solvent is added, and heating is carried out at temperature of −5 to +50° C. of the Tg of the fine polymer particles. However, the addition sequence of each additive is not particularly limited, nor is the production method limited to one described above.

For example, when the heating temperature is kept constant, particle shape approaches true sphere with an increase in the heating time. Furthermore, when the heating temperature is elevated, the rate of approaching the true sphere is accelerated.

Several coefficients are proposed as the index showing shape. For example, as the degree of non-sphericity, the value described below is one possibility.

Degree of non-sphericity=(BET specific surface area of non-spherical particle)/(surface area which is calculated as a true sphere from the average particle diameter of non-spherical particles).

The above-mentioned degree of non-sphericity of non-spherical particle is preferably at least 1.1; is more preferably between 1.1 and 5.0; and is most preferably between 1.2 and 3.5.

(Electrostatic Image Developing Toner)

Because non-spherical particles are employed as the toner for developing an electrostatic image, the volume average particle diameter is preferably between 3 and 25 μm, and is most preferably between 1.2 and 3.5 μm. Specifically, the toner particles of the present invention hold a narrow particle size distribution even though the particle diameter decreases. Thus, without performing post-treatments such as a classification process, etc., high yield is obtained to preferably employ as the toner with a small particle diameter.

The non-spherical particles are individually employed as toner. However, employed as fluidizing agents, may be, in combination, silica, titanium oxide, aluminum oxide and hydrophobically treated materials thereof. The fluidizing agent is preferably added in an amount of 0.01 to 20 parts by weight with respect to 100 parts by weight of toner, and is more preferably in an amount of 0.1 to 10 parts by weight.

Furthermore, listed as slipping agents, are metallic salts of higher fatty acids such as cadmium, barium, nickel, cobalt, strontium, copper, magnesium, calcium salts, etc. of stearic acid; zinc, manganese, iron, cobalt, copper, lead, magnesium salts, etc. of oleic acid; zinc, cobalt, and calcium salts of linoleic acid; zinc and cadmium salts of ricinolic acid; lead salts of caproic acid; etc. These may be added if desired.

(Image Forming Method employed in the Present Invention)

Examples of image forming methods are described.

FIG. 1 is a sectional view of a development apparatus (development device) which is employed in the image forming method of the present invention. In the figure, the reference numeral 41 is a development sleeve which is a developer material transport member comprising a fixed magnetic body 42; the reference numeral 47 is a scraper which is a developer material removing member; the reference numeral 48 refers to two stirring rollers which are two developer material stirring members; the reference numeral 49 is a housing of the development apparatus; the reference numeral 50 is a two component developer material (in the present invention, the addition of carrier is not always required and single component development may be carried out only employing toner) consisting of toner T and carrier C; the reference numeral 51 is a power source as a bias application means; the reference numeral 10 is a photoreceptor drum which is an image forming body composed of a conductive base body 11 having thereon a photosensitive layer 12; and $D_1$ is the closest distance between the above-mentioned photoreceptor drum 10 and the above-mentioned development sleeve 41. Furthermore, the arrow in 10 of FIG. 1 shows the rotation direction of the above-mentioned photoreceptor drum 10 and the above-mentioned development sleeve 41.

The development sleeve 41 is a cylinder with a diameter of 0.5 to 3 cm, which is composed of non-magnetic and electrically conductive metal such as aluminum, stainless steel, etc. and its surface is machined so as to exhibit the surface roughness (Rz) of 1 to 30 μm. In the interior of the above-mentioned development sleeve 41, a magnetic body 42 in an cylindrical or columnar assembly, etc. having 4 to 12 magnetic poles, which are magnetized in a N pole or S pole, is fixedly arranged and is rotably disposed against the above-mentioned magnetic body 42.

The housing 49 is composed of insulating resin such as, for example, acrylic, polycarbonate, etc., in the interior of the housing 49, are arranged the development sleeve 41 enclosing the above-mentioned fixed magnetic body 42, the feeding roller 45, the scraper 47 and the stirring rollers 48, and at the outlet of the above-mentioned housing 49, a regulating rod 46 is mounted.

In the interior of the above-mentioned housing 49, is stored two component developer material 50 consisting of toner T and carrier C. The above-mentioned two component developer material 50 is stir-mixed employing the above-mentioned stirring rollers 48; is simultaneously fed employing the above-mentioned feeding roller 45; and is adhered onto the above-mentioned development sleeve 41 to form a magnetic brush. The resulting brush is transported employing the above-mentioned regulating rod 46 in accordance with the rotation of the above-mentioned development sleeve 41 while the transport amount is controlled.

An alternative current voltage, having a direct current component, from the above-mentioned power source 51 is applied to the above-mentioned development sleeve 41, and strong oscillating electric field is generated at the gap between the above-mentioned development sleeve 41 and the above-mentioned photoreceptor drum 10. Toner detaches from the carrier due to the strong oscillating electric field and is subjected to jumping to form toner cloud. Due to this, jumping is generated, which is directed onto the latent image on the above-mentioned photoreceptor drum 10 and a toner image is formed on the above-mentioned photoreceptor drum 10.

Figure 2:
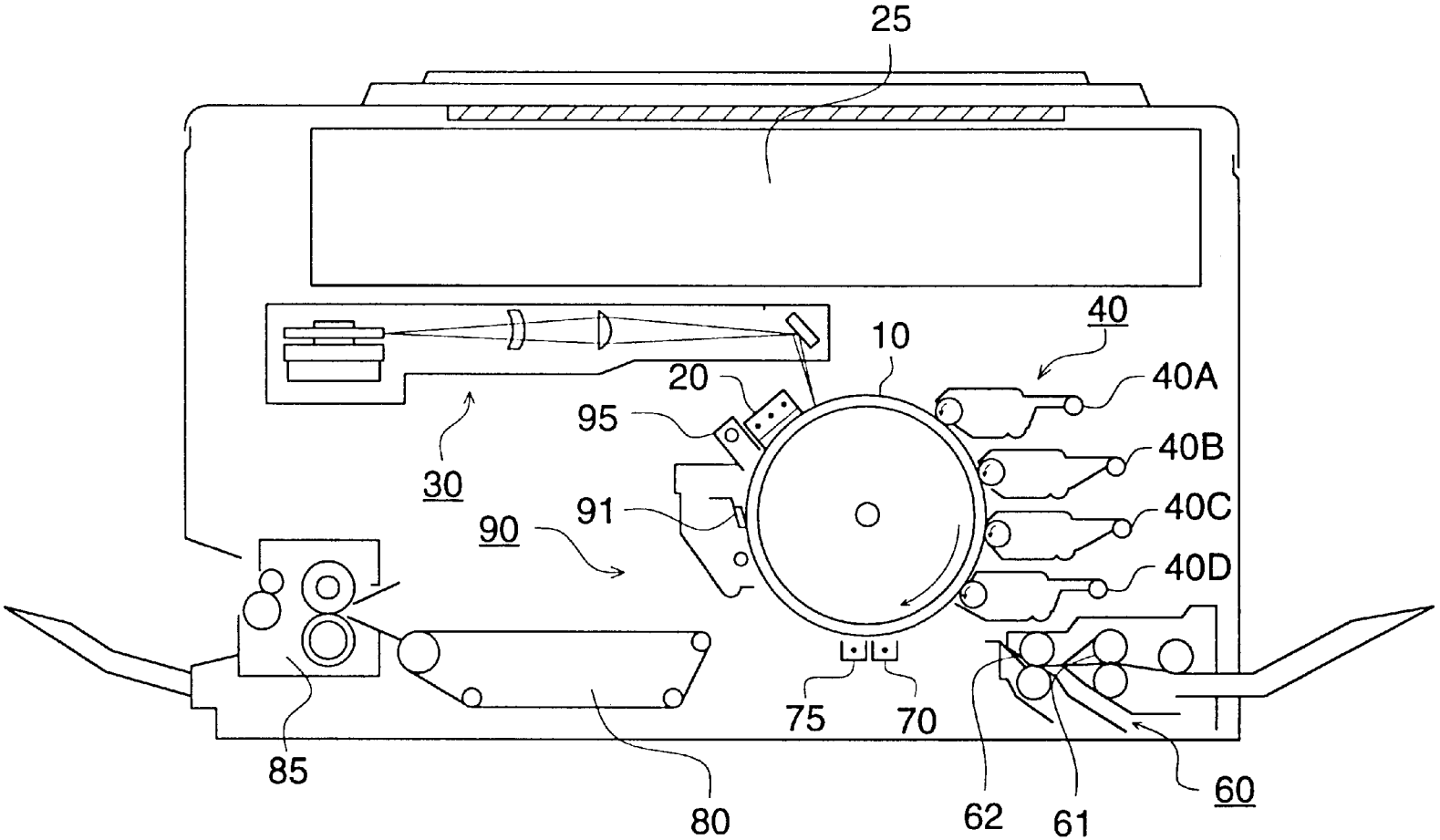
FIG. 2 is a sectional view showing one example of an apparatus illustrating the image forming method according to the present invention.

FIG. 2 is a sectional view of an apparatus to describe one example of the image forming method of the present invention. In FIG. 2, the reference numeral 10 is a photoreceptor drum which is an image forming body; the reference numeral 20 is a scorotron charging device as a charging means; the reference numeral 25 is an image reading section; the reference numeral 30 is an image writing section employing a laser beam as an exposure means; the reference numerals 40A, 40B, 40C, and 40D are development apparatuses accommodating the different colored two component developer materials, shown in FIG. 1; the reference numeral 60 is a paper feeding section provided with first paired paper feeding rollers 61 and second paired paper feeding rollers 62; the reference numeral 70 is a transfer corona charging device employed as a transfer means; the reference numeral 75 is a separation corona charging device employed as a separation means; the reference numeral 80 is a transporting section; the reference numeral 85 is a fixing section; the reference numeral 90 is a cleaning device provided with a cleaning blade 91; and the reference numeral 95 is an exposure lamp employed prior to charging. Furthermore, the arrow in FIG. 2 shows the rotation direction of the above-mentioned photoreceptor drum 10.

The basic operation of multicolor image forming processes employing the present embodiment is as follows: first, a copying commencing command is transmitted from an operation section (not shown) to a control section (also not shown), and the photoreceptor drum 10 starts rotating; in response to the rotation of the above-mentioned photoreceptor drum 10, the circumferential surface is uniformly charged employing the scorotron charging device 20; furthermore, in the image reading section 25, optical information from an original document is converted into electrical signals; and image processing is applied to the above-mentioned electrical signals. Thereafter, the resulting signals are inputted into the image writing section 30. Laser beams from the image writing section 30 irradiate the above-mentioned charged photoreceptor drum 10 and a latent image is formed on the above-mentioned photoreceptor drum 10. The latent image on the above-mentioned photoreceptor drum 10 is developed employing any of the above-mentioned development apparatuses 40A, 40B, 40C, and 40D, and a toner image is formed on the above-mentioned photoreceptor drum 10.

The photoreceptor drum 10 on which the above-mentioned toner image is formed is uniformly re-charged employing the above-mentioned scorotron charging device 20, and is irradiated with laser beams from the above-mentioned image writing section 30 to subsequently form a latent image. The latent image on the above-mentioned photoreceptor drum 10 is developed employing any of the above-mentioned development apparatuses 40A, 40B, 40C, and 40D, and the subsequent toner image is superimposed onto the above-mentioned photoreceptor drum 10.

To form a multi-color image, the latent image forming process and the development process are repeated four times so that four different color toner images are superimposed on the above-mentioned photoreceptor drum 10.

In the paper feeding section 60, transfer sheets (in the present invention, it is possible, without particular limitation, to employ those onto which a prefixed toner image can be transferred) as a transfer material are stored, and the transfer sheet is transported to the transfer corona charging device 70 in synchronization with the superimposed toner images on the above-mentioned photoreceptor drum 10, employing the first paired paper feeding rollers 61 and the second paired paper feeding rollers 62. The above-mentioned toner images which are superimposed on the above-mentioned photoreceptor drum 10 are transferred onto a recording sheet employing the above-mentioned transfer corona charging device, and the transfer sheet is separated from the above-mentioned photoreceptor drum 10 employing the separation corona charging device 75. The transfer sheet onto which the toner images are transferred is transported to the fixing section 85 via the transporting section 80, and after being melt-press-fixed, is ejected to the exterior of the apparatus.

On the other hand, the toner which is not transferred onto a transfer sheet and remains on the above-mentioned photoreceptor drum 10 is scraped off employing a cleaning device 90 provided with a cleaning blade 91 which is in pressure contact with the above-mentioned photoreceptor drum 10, while taking timing, and after the residual electrical potential is removed, employing a pre-charging exposure lamp 95, the image forming process is repeated.

Both non-contact development, to which an alternative current voltage is generally applied, and contact development may be utilized for development. Furthermore, as described above, it is not required to prepare a multi-color image and it is employed as a single color image forming method.

EXAMPLES

The present invention will now be detailed below with reference to Examples.

(Preparation of Fixability Improving Agent Emulsifying Dispersion)

To 240 g of low molecular weight polypropylene (number average molecular weight of 3,300 and at a molecular weight distribution (Mw/Mn) of 4.5), 11.4 g of maleic acid anhydride were added to result in modification based on the method known in the art and the melt viscosity was measured. Thereafter, the fixability improving agent of the present invention was added to 560 g of an aqueous nonylphenoxyethanol solution (the number of moles of ethoxy unit addition of 20 at a HLB of 16.0) in which hydrochloric acid was dissolved; the pH of the resulting mixture was adjusted to 9 employing sodium hydroxide, and emulsifying dispersion was carried out at higher temperature than the softening point of the modified propylene by applying pressure and elevating the temperature. The dispersed particle diameter of this modified polypropylene was measured employing a light scattering electrophoresis particle diameter measurement apparatus (ELS-800, manufactured by Otsuka Denshi Kogyo Co.) and 182 nm was obtained. The resulting fixability improving emulsifying dispersion was denoted a fixation improving agent emulsifying dispersion.

(Preparation of Pigment Dispersion 1)

Added to 5,000 ml of deionized water, were 267 g of carbon black (Regal 330R manufactured by Cabot Co.) and 122.75 g of sodium dodecylsulfate, and the resulting mixture was dispersed employing both of an ultrasonic homogenizer and a pressure type homogenizer. The average diameter of carbon black particles in the dispersion was measured employing a light scattering electrophoresis particle diameter measurement apparatus (ELS-800 manufactured by Otsuka Denshi Kogyo Co.) and 95 nm was obtained.

(Preparation of Pigment Dispersions 2, 3 and 4)

Pigment Dispersions 2, 3, and 4 were prepared in the same manner as Pigment Dispersion 1, except that instead of the carbon black in Pigment Dispersion 1, pigments, C.I. Pigment Yellow 17, C.I. Pigment Red 122, and C.I. Pigment Blue 15:3 were employed respectively. The average diameters of pigments in the dispersions were measured employing a light scattering electrophoresis particle diameter measurement apparatus (ELS-800, manufactured by Otsuka Denshi Kogyo Co.) and 148 nm, 133 nm, and 105 nm were obtained, respectively.

(Synthesis of Electrostatic Image Developing Toner Suspension 1)

Put in a 20-liter four-neck flask equipped with a cooling pipe, a thermometer, a stirrer, and a nitrogen gas introducing pipe, were 426 ml of Pigment Dispersion 1, 3,200 ml of distilled water, 421.4 g of styrene, 80 g of n-butyl acrylate, 32 g of methacrylic acid, 0.6 g of tert-dodecylmercaptan, and 106 g of the fixation improving agent emulsifying dispersion, and the resulting mixture was stirred at a rate of 210 rpm and was heated under a nitrogen gas flow until the interior temperature of the flask reached 70° C. While maintaining the interior temperature at 70° C., an aqueous polymerization initiating agent solution prepared by dissolving 8.2 g of potassium persulfate in 660 ml of deionized water was added and polymerization was carried out under a nitrogen gas flow for 3 hours maintaining the inside temperature at 70° C. and the stirring rate of 210 rpm. After completing polymerization, the inside temperature was lowered to room temperature. Thereafter, 854 ml of Pigment Dispersion 1, 6,400 ml of distilled water, 842 g of styrene, 160 g of n-butyl acrylate, 64 g of methacrylic acid, 36.6 g of tert-dodecylmercaptan, and 212 g of fixation improving agent emulsifying dispersion were added. The resulting mixture was stirred at 210 rpm and heated under a nitrogen gas flow until the interior temperature of the flask reached 70° C. While maintaining the interior temperature of 70° C., an aqueous polymerization initiating agent solution prepared by dissolving 16.4 g of potassium persulfate in 1,320 ml of deionized water was added, and polymerization was carried out under a nitrogen gas flow for 3 hours while maintaining the interior temperature of 70° C. at a stirring rate of 210 rpm. After completing polymerization, the interior temperature was allowed to fall to room temperature.

Subsequently, 10 liters of this colorant containing fine organic particle dispersion was treated to obtain a pH of 9.8 employing 5N sodium hydroxide; the resulting dispersion was put into 20-liter four-neck flask equipped with a stirrer, a cooling pipe, and a thermal sensor, and was then stirred at 140 rpm. Added then, was an aqueous electrolytic solution prepared by dissolving 473.4 g of sodium chloride in 1,400 ml of distilled water, and further added were 898 ml of isopropyl alcohol and an aqueous nonionic surface active agent solution prepared by dissolving 34 g of Triton X-100 in 400 ml of distilled water. Thereafter, the resulting mixture was heated to the interior temperature of 85° C. and was allowed to reaction for 6 hours.

(Synthesis of Electrostatic Image Developing Toner Suspension 2)

Put into a 10-liter four-neck flask equipped with a cooling pipe, a thermometer, a stirrer, and a nitrogen gas introducing pipe, were 213 ml of Pigment Dispersion 2, 1,600 ml of distilled water, 210.7 g of styrene, 40 g of n-butyl acrylate, 16 g of methacrylic acid, 0.3 g of tert-dodecylmercaptan, and 53 g of the fixation improving agent emulsifying dispersion, and the resulting mixture was stirred at 250 rpm and heated under a nitrogen gas flow until the interior temperature of the flask reached 70° C. While maintaining the interior temperature of 70° C., an aqueous polymerization initiating agent solution, prepared by dissolving 4.1 g of potassium persulfate in 330 ml of deionized water, was added and polymerization was carried out under nitrogen gas flow for 3 hours while maintaining the interior temperature of 70° C. and stirring at 250 rpm. After completing polymerization, the interior temperature was allowed to fall to room temperature. Thereafter, 427 ml of carbon black dispersion, 3,200 ml of distilled water, 421 g of styrene, 80 g of n-butyl acrylate, 32 g of methacrylic acid, 18.3 g of tert-dodecylmercaptan, and further 106 g of fixation improving agent emulsifying dispersion were added. The resulting mixture was stirred at 250 rpm and heated under a nitrogen gas flow until the interior temperature of the flask reached 70° C. While maintaining the interior temperature of 70° C., added was an aqueous polymerization initiating agent solution, prepared by dissolving 8.2 g of potassium persulfate in 660 ml of deionized water, and polymerization was carried out under a nitrogen gas flow for 3 hours while maintaining the interior temperature of 70° C. and stirring rate of 250 rpm. After complete polymerization, the interior temperature was allowed to fall to room temperature.

Further, 2,500 ml of this colorant containing fine organic particle dispersion, was treated to obtain a pH of 9.8 employing 5N sodium hydroxide; the resulting dispersion was placed into a 5,000 ml four-neck flask equipped with a stirrer, a cooling pipe, and a thermal sensor, and stirred at 210 rpm. Then, an aqueous electrolytic solution, prepared by dissolving 147.3 g of sodium chloride in 700 ml of distilled water, was added, and further, 449 ml of isopropyl alcohol and an aqueous nonionic surface active agent solution, prepared by dissolving 17 g of Triton X-100 in 200 ml of distilled water, were successively added. Thereafter, the resulting mixture was heated to the interior temperature of 85° C. and allowed to reaction for 6 hours.

(Synthesis of Electrostatic Image Developing Toner Suspension 3)

Electrostatic Image Developing Toner Suspension 3 was prepared in the same manner as Electrostatic Image Developing Toner Suspension 2, except that Pigment Dispersion 2 employed in the synthesis of Electrostatic Image Developing Toner Suspension 2 was replaced with Pigment Dispersion 3.

(Synthesis of Electrostatic Image Developing Toner Suspension 4)

Electrostatic Image Developing Toner Suspension 4 was prepared in the same manner as Electrostatic Image Developing Toner Suspension 2, except that Pigment Dispersion 2 employed in the synthesis of Electrostatic Image Developing Toner Suspension 2 was replaced with Pigment Dispersion 4.

(Preparation of Electrostatic Image Developing Toner 1)

After filtering 2,500 ml of Electrostatic Image Developing Toner Suspension 1, the resulting residue was re-dispersed by the addition of distilled water, and after adjusting the pH to 13, employing 5N sodium hydroxide, water washing and filtration were repeated seven times to remove the surface active agent and electrolytes. After washing, drying was carried out at 38° C. under normal pressure to obtain Electrostatic Image Developing Toner 1.

(Preparation of Electrostatic Image Developing Toner 2)

After filtering 2,500 ml of Electrostatic Image Developing Toner Suspension 1, the resulting residue was re-dispersed by the addition of distilled water, and after adjusting the pH to 13 employing 5N sodium hydroxide, water washing and filtration were repeated seven times to remove the surface active agent and electrolytes. After washing, drying was carried out at 43° C. under normal pressure to obtain Electrostatic Image Developing Toner 2.

(Preparation of Electrostatic Image Developing Toner 3)

After filtering 2,500 ml of Electrostatic Image Developing Toner Suspension 1, the resulting residue was re-dispersed by the addition of distilled water, and after adjusting the pH to 13, employing 5N sodium hydroxide, employing a solvent mixture of 5 methanol/5 water as a washing solvent, washing and filtration were repeated seven times to remove the surface active agent and electrolytes. After washing, drying was carried out at 38° C. under normal pressure to obtain Electrostatic Image Developing Toner 3.

(Preparation of Electrostatic Image Developing Toner 4)

After filtering 2,500 ml of Electrostatic Image Developing Toner Suspension 1, the resulting residue was re-dispersed by the addition of distilled water, and after adjusting the pH to 13 employing 5N sodium hydroxide, employing a solvent mixture of 5 methanol/5 water as a washing solvent, washing and filtration were repeated seven times to remove the surface active agent and electrolytes. After washing, drying was carried out at 38° C. under evacuation (at not more than 100 mmHg) to obtain Electrostatic Image Developing Toner 4.

(Preparation of Electrostatic Image Developing Toner 5)

Electrostatic Image Developing Toner 5 was prepared in the same manner as the preparation example of Electrostatic Image Developing Toner 1, except that Electrostatic Image Developing Toner Suspension 1 was replaced with Electrostatic Image Developing Toner Suspension 2.

(Preparation of Electrostatic Image Developing Toner 6)

Electrostatic Image Developing Toner 6 was prepared in the same manner as the preparation example of Electrostatic Image Developing Toner 1, except that Electrostatic Image Developing Toner Suspension 1 was replaced with Electrostatic Image Developing Toner Suspension 3.

(Preparation of Electrostatic Image Developing Toner 7)

Electrostatic Image Developing Toner 7 was prepared in the same manner as the preparation example of Electrostatic Image Developing Toner 1, except that Electrostatic Image Developing Toner Suspension 1 was replaced with Electrostatic Image Developing Toner Suspension 4.

(Preparation of Comparative Electrostatic Image Developing Toner 1)

After filtering 2,500 ml of Electrostatic Image Developing Toner Suspension 1, the resulting residue was re-dispersed by the addition of distilled water, and after adjusting the pH to 13 employing 5N sodium hydroxide, employing methanol as a washing solvent, washing and filtration were repeated seven times to remove the surface active agent and electrolytes. After washing, drying was carried out at 38° C. to obtain Comparative Electrostatic Image Developing Toner 1.

(Preparation of Comparative electrostatic Image Developing Toner 2)

After filtering 2,500 ml of Electrostatic Image Developing Toner Suspension 1, the resulting residue was re-dispersed by the addition of distilled water, and after adjusting the pH to 13 employing 5N sodium hydroxide, employing methanol as a washing solvent, washing and filtration were repeated seven times to remove the surface active agent and electrolytes. After washing, drying was carried out under evacuation (at not more than 100 mmHg) at 38° C. to obtain Comparative Electrostatic Image Developing Toner 2. After drying, each of Electrostatic Image developing Toners 1 through 7 and Comparative Electrostatic Image Developing Toners 1 and 2, the molecular weight was measured employing GPC, and the particle diameter was measured employing a Coulter counter. Further, the pore volume ratio of particles having a pore diameter of not more than 0.1 μm was measured employing a mercury pressure introduction type pore distribution measurement apparatus, Poresizer 9320 type (manufactured by Shimadzu Seisakusho). Table 1 also shows the measured results.

| Sample | Molecular Weight (MW) | Particle Diameter (μm) | Pore Volume Ratio (%) |
|---|---|---|---|
| Electrostatic Image Developing Toner | | | |
| 1 | 37541 | 6.48 | 10.54 |
| 2 | 37541 | 6.48 | 7.32 |
| 3 | 37541 | 6.48 | 17.17 |
| 4 | 37541 | 6.48 | 22.89 |
| 5 | 38647 | 6.77 | 11.24 |
| 6 | 40058 | 6.52 | 10.71 |
| 7 | 39267 | 6.83 | 10.33 |

-continued

| Sample | Molecular Weight (MW) | Particle Diameter (μm) | Pore Volume Ratio (%) |
|---|---|---|---|
| Comparative Electrostatic Image Developing | | | |
| 1 | 37541 | 6.48 | 35.47 |
| 2 | 37541 | 6.48 | 39.60 |

Evaluation

Employing Electrostatic Image Developing Toners 1 through 7 of the present invention and Comparative Electrostatic Image Developing Toners 1 and 2, 100 parts by weight of each of these toners were mixed with 2 parts by weight of hydrophobic silica and 1 parts by weight of titanium oxide, and were further mixed with 5 parts by weight of this toner subjected to treatment with external additives and 95 parts by weight of ferrite particles (a carrier with an average particle diameter of 60 μm) of which surfaces were coated with methyl methacrylate/styrene copolymer (MAA/St=7/3 by weight ratio). The resulting developer materials were denoted Present Invention Developer Materials 1 through 7 and Comparative Developer Materials 1 and 2.

A long printing run was carried out employing each of the above-mentioned developer materials and a modified color copier Konica 9028 manufactured by Konica Corp.

Conditions were those described below.

As a photoreceptor, a lamination type organic photoreceptor was employed.

Photoreceptor surface potential=−550V

DC bias=−250V

AC bias=Vp−p: −50 to −450V

Alternating electric field frequency=1,800 Hz

Dsd (distance between a photoreceptor and a development sleeve)=300 μm

Pressing pressure regulating force=10 gf/mm

Pressing pressure regulating rod=SUS 416 (made of stainless steel)/3 mm in diameter Thickness of developer material layer=150 μm Development sleeve=20 mm A long printing run was carried out under normal temperature and low relative humidity (25° C./RH 30%) as the ambient conditions and an image having a pixel ratio of 1 percent was printed onto ten thousand sheets. The charge amount at the start and completion of printing ten thousand sheet was measured employing a blow-off method. Table 2 shows the measured results, which reveals that toner in which pore volume having a pore diameter of not more than 0.1 μm is not more than 30 percent of the toner volume results in stability in a charge amount at the start and completion of printing ten thousand sheets.

TABLE 2

| Sample | Charge amount (μC/g) Start | Charge amount (μC/g) Completion of Printing Ten Thousand Sheets |
|---|---|---|
| Toner | | |
| 1 | −35.7 | −32.3 |
| 2 | −35.4 | −33.1 |
| 3 | −34.9 | −30.7 |
| 4 | −34.6 | −30.1 |
| 5 | −35.2 | −31.8 |
| 6 | −34.8 | −30.9 |

TABLE 2-continued

| Sample | Charge amount (μC/g) Start | Completion of Printing Ten Thousand Sheets |
|---|---|---|
| Toner | | |
| 7 | −35.6 | −31.4 |
| Comparative Toner | | |
| 1 | −35.5 | −19.4 |
| 2 | −34.7 | −12.1 |

As can clearly be seen in table 2, the present invention exhibits stability in the charge amount after printing of ten thousand sheets.

With the present invention, it is possible to provide toner which does not cause an unstable charge amount over an extended period of use, and an image forming method employing the same.

We claim:

1. A toner for developing an electrostatic image, which is composed of association of a plurality of fine polymer particles, wherein total volume of pores having a pore diameter not more than 0.1 μm on the surfaces of the toner particles is not more than 30 percent of the volume of all pores on the surfaces of the particles.

2. The toner of claim 1, wherein particle size of the fine polymer particles is 0.01 to 10 μm.

3. The toner of claim 2, wherein particle size of the fine polymer particles is 0.01 to 2 μm.

4. The toner of claim 1, wherein the fine polymer particles comprise a monomer unit having an ionic dissociation group.

5. The toner of claim 1, wherein the fine polymer particles comprise a monomer unit having an ionic dissociation group, and a part or all of the ionic dissociation groups are in a dissociated state.

6. The toner of claim 4, wherein an amount of the ionic dissociation group is 0.1 to 30 weight percent of the total monomers.

7. The toner of claim 6, wherein an amount of the ionic dissociation group is 0.5 to 20 weight percent of the total monomers.

8. The toner of claim 4, wherein the monomer unit having an ionic dissociation group is a monomer containing a carboxyl group, a sulfonic acid group, a phosphoric acid group, an amino group or a quaternary ammonium group.

9. The toner of claim 1, wherein toner particle is not spherical.

10. The toner of claim 1, wherein the total volume of pores having a pore diameter of not more than 0.1 μm on the surface of the toner is not more than 25 percent.

11. The toner of claim 1, wherein Tg of fine polymer particles is from −10 to 120° C. and softening point of fine polymer particles is 80 to 220° C.

12. The toner of claim 1, wherein the molecular weight is 2,000 to 1,000,000 in terms of weight average molecular weight, and the the ratio of the weight average molecular weight to the number average molecular weight is 1.5 and 100.

13. The toner of claim 1, wherein degree of non-sphericity (BET specific surface area of non-spherical particle)/(surface area calculated as a true sphere from the average particle diameter of particles) of the toner particles is 1.1 and 5.0.

14. The toner of claim 3, wherein the fine polymer particles comprise a monomer unit having an ionic dissociation group, an amount of the ionic dissociation group is 0.5 to 20 weight percent of the total monomers and the monomer unit having an ionic dissociation group is a monomer containing a carboxyl group, a sulfonic acid group, a phosphoric acid group, an amino group or a quaternary ammonium group.

15. The toner of claim 2, wherein the monomer unit having an ionic dissociation group is a monomer containing a carboxyl group, a sulfonic acid group, a phosphoric acid group, an amino group or a quaternary ammonium group, an amount of the ionic dissociation group is 0.1 to 30 weight percent of the total monomers, Tg of fine polymer particles is from −10 to 120° C. and softening point of fine polymer particles is 80 to 220° C., and degree of non-sphericity (BET specific surface area of non-spherical particle)/(surface area calculated as a true sphere from the average particle diameter of particles) of the toner particles is 1.1 and 5.0.

16. The toner of claim 15, wherein the volume average particle size is 3 to 25 μm.

17. The toner of claim 14, wherein the total volume of pores having a pore diameter of not more than 0.1 μm on the surface of the toner is not more than 25 percent, the molecular weight is 2,000 to 1,000,000 in terms of weight average molecular weight, and the the ratio of the weight average molecular weight to the number average molecular weight is 1.5 and 100, and the volume average particle size is 3 to 25 μm.

18. An image forming method wherein an electrostatic latent image formed on a photoreceptor is developed employing the toner of claim 1 to form a toner image.

19. The image forming method of claim 18 wherein the toner image formed on the photoreceptor is transferred onto a transfer material.

20. The image forming method of claim 18 wherein after a toner image is formed on the photoreceptor, any toner which remains on the photoreceptor is removed employing an cleaning means.

* * * * *